US007017241B2

(12) United States Patent
Bentsen

(10) Patent No.: US 7,017,241 B2
(45) Date of Patent: Mar. 28, 2006

(54) SLIDER HAVING INTERIOR RIDGE TO ASSIST ZIPPER OPENING

(75) Inventor: Per Bentsen, Suffern, NY (US)

(73) Assignee: Illinois Tool Works Inc., Glenview, IL (US)

( * ) Notice: Subject to any disclaimer, the term of this patent is extended or adjusted under 35 U.S.C. 154(b) by 106 days.

(21) Appl. No.: 10/228,355

(22) Filed: Aug. 26, 2002

(65) Prior Publication Data

US 2004/0037479 A1 Feb. 26, 2004

(51) Int. Cl.
*A44B 19/16* (2006.01)

(52) U.S. Cl. ..... 24/400

(58) Field of Classification Search ..... 24/30.5 R, 24/399, 30.5 P, 400, 427, DIG. 50, 585.1, 24/585.11, 585.12; 383/63, 64, 68, 69; 53/139.2, 53/133.4, 412; 493/213, 214
See application file for complete search history.

(56) References Cited

U.S. PATENT DOCUMENTS 6,047,450 A 4/2000 Machacek et al. ..... 24/399
6,306,071 B1 * 10/2001 Tomic ..... 493/213
6,524,002 B1 * 2/2003 Tomic ..... 383/64
2003/0000050 A1 * 1/2003 Blythe ..... 24/399
2003/0167606 A1 * 9/2003 McMahon et al. ..... 24/428
2004/0045141 A1 * 3/2004 McMahon et al. ..... 24/399

* cited by examiner

*Primary Examiner*—James R. Brittain
(74) *Attorney, Agent, or Firm*—Ostrager Chong Flaherty & Broitman P.C.

(57) ABSTRACT

A slider that reduces the tendency of a slider-zipper assembly to deactivate under freezer conditions. One embodiment of the slider comprises an opening window comprising a top portion, first and second side portions respectively connected to opposing ends of the top portion of the opening window, and a keeper connected to and projecting downward from the top portion, the keeper being disposed closer to the first side portion than to the second side portion of the opening window; a closing window comprising a top portion, and first and second side portions respectively connected to opposing ends of the top portion of the closing window, the closing window being separated from the opening window by a central zone; and a pair of opposing ridges located in the central zone proximal to the opening window and comprising respective convex surface of curving form. The ridges cam the profiled closure members of the zipper together and cam the male-profiled closure member toward the keeper.

24 Claims, 8 Drawing Sheets

SLIDER HAVING INTERIOR RIDGE TO ASSIST ZIPPER OPENING

BACKGROUND OF THE INVENTION

This invention generally relates to slider-operated zippers for use in reclosable packaging, such as bags or pouches. In particular, the invention relates to sliders of the type that do not have a separating finger.

Reclosable bags are finding ever-growing acceptance as primary packaging, particularly as packaging for foodstuffs such as cereal, fresh vegetables, snacks and the like. Such bags provide the consumer with the ability to readily store, in a closed, if not sealed, package any unused portion of the packaged product even after the package is initially opened. To gain acceptance as a primary package for foodstuffs, it is virtually mandatory that the package exhibit some form of tamper evidence to protect the consumer and maintain the wholesomeness of the contained product. In addition, in many cases it is necessary that food product be hermetically packaged.

Reclosable fastener assemblies are useful for sealing thermoplastic pouches or bags. Such fastener assemblies typically include a plastic zipper and a plastic slider. Typically, the plastic zippers include a pair of interlockable profiled members that form a closure. As the slider moves across the profiles, the profiles are opened or closed. The profiles in plastic zippers can take on various configurations, e.g. interlocking rib and groove elements having so-called male and female profiles, interlocking alternating hook-shaped closure members, etc. Reclosable bags having slider-operated zippers are generally more desirable to consumers than bags having zippers without sliders because the slider eliminates the need for the consumer to align the interlockable zipper profiles before causing those profiles to engage.

In one type of slider-operated zipper assembly, the slider straddles the zipper and has a separating finger at one end that is inserted between the profiles to force them apart as the slider is moved along the zipper in an opening direction. The other end of the slider is sufficiently narrow to force the profiles into engagement and close the zipper when the slider is moved along the zipper in a closing direction. Other types of slider-operated zipper assemblies avoid the use of a separating finger. For example, U.S. Pat. No. 6,047,450 discloses a zipper comprising a pair of mutually interlockable profiled closure members, portions of which form a fulcrum about which the profiled closure members may be pivoted out of engagement when lower edges of the bases are forced towards each other.

Another known slider of the above-described type has a so-called "keeper" projecting vertically downward from the opening end of the top wall of the slider. The keeper mates with a recess in the male-profiled closure member of the zipper, holding the male-profiled closure member partially away from the female-profiled closure member. By preventing movement of the one closure member towards the other closure member, the zipper profiles always remain at least partially disengaged at the opening end of the slider, thereby reducing the possibility of an unintentional full engagement of the closure members adjacent the opening end or within the slider and facilitating the opening movement of the zipper. In one known slider insertion machine, the zipper tape is "activated" during slider insertion The term "activation" as used herein means that opposing sections of the zipper closure members at the opening end of the slider are at least partially disengaged and held in that state by the keeper. The term "deactivation" as used herein means that the zipper profiles become engaged at the opening end of the slider and are no longer held partly disengaged by the keeper.

The above-described slider-operated zipper, with keeper maintaining the zipper in an activated state, must perform satisfactorily over a wide range of temperatures. In particular, it is desirable that this slider/zipper system perform satisfactorily under freezer temperature conditions, to wit, −5° F. to +5° F. The zipper becomes very stiff at these temperatures. This leads to much higher forces to move the slider back and forth along the zipper. The increased zipper stiffness can also lead to deactivation of the slider/zipper assembly since the recess will not stay on the keeper, which renders the reclosable zipper very difficult to operate, if not non-functional. There is a need for a slider design that reduces the tendency of the slider-zipper assembly to deactivate under freezer conditions.

BRIEF DESCRIPTION OF THE INVENTION

The invention is directed to sliders that reduce the tendency of the slider-zipper assembly to deactivate under freezer conditions; to slider-zipper assemblies incorporating such a slider; and to reclosable packages incorporating slider-zipper assemblies having such a slider.

One aspect of the invention is a slider for opening and closing a plastic zipper, comprising: an opening window having a top portion, first and second side portions respectively connected to opposing ends of the top portion of the opening window, and a keeper connected to and projecting downward from the top portion, the keeper being disposed closer to the first side portion than to the second side portion of the opening window; a closing window comprising a top portion, and first and second side portions respectively connected to opposing ends of the top portion of the closing window, the closing window being separated from the opening window by a central zone; and a ridge located in the central zone proximal to the opening window and comprising a convex surface of curving form.

Another aspect of the invention is a slider for opening and closing a plastic zipper of the type having a fulcrum, comprising: first and second side walls separated by space occupied in part by the zipper; a first beam having one end connected to the first side wall and the other end connected to the second side wall, the first beam and respective first portions of the first and second side walls adjoining the first beam defining an opening window; a second beam one end connected to the first side wall and the other end connected to the second side wall, the second beam and respective second portions of the first and second side walls adjoining the second beam defining a closing window; first and second tabs respectively projecting from the first and second side walls and toward each other for retaining the slider on the zipper; and a ridge projecting from the first side wall proximal to the opening window and comprising a convex surface of curving form.

Yet another aspect of the invention is a slider for use on a zipper of the type comprising a first profiled interlockable member and a second profiled interlockable member adapted to interlock with the first interlockable member, the slider comprising: a pair of spaced apart arms defining at opposite ends of the arms a zipper opening end of the slider that disengages adjoining first portions of the first and second interlockable members and a zipper closing end of the slider that interlocks adjoining second portions of the first and second interlockable members; bridge means that span a gap between the arms, the bridge means being connected to top portions of the arms; means for keeping the first portion of the first interlockable member at least partially disengaged from the first portion of the second interlockable member in the zipper opening end; means for camming the first portion of the first interlockable member upward toward the keeping means when the slider is moved in a zipper opening direction; and means for retaining the slider on the zipper.

Another aspect of the invention is an assembly comprising a pair of interlockable profiled closure members and a slider mounted to the profiled closure members and movable in either a first direction to cause the profiled closure members to interlock with each other or in a second direction to cause the profiled closure members to disengage from each other, wherein the slider is as described in any of the three preceding paragraphs.

A further aspect of the invention is a slider-zipper assembly comprising: first and second interlockable profiled closure members each having a respective substantially constant profile along its length, the first profiled closure member comprising a recess that does not engage the second profiled closure member; and a slider mounted to the first and second profiled closure members and movable in either a first direction to cause the profiled closure members to interlock with each other or in a second direction to cause the profiled closure members to disengage from each other, wherein the slider comprises a closing section that is penetrated by respective first portions of the first and second profiled closure members, the closing end being configured such that the first portions of the first and second profiled closure members can penetrate the closing end only if the first portions are interlocked; an opening section penetrated by respective second portions of the first and second profiled closure members, the opening end being configured such that the second portions of the first and second profiled closure members can penetrate the opening end when the second portions are not interlocked, the opening section comprising a keeper that engages the recess in the first profiled closure member; and a central section connecting the opening section to the closing section, the central section comprising a ridge proximal to the opening section, the ridge comprising a convex surface of curving form having a shape designed to maintain the recess of the second portion of the first profiled closure member in engagement with the keeper when the slider is traveling in the second direction.

Another aspect of the invention is a slider-zipper assembly comprising: first and second interlockable profiled closure members each having a respective substantially constant profile along its length, the first profiled closure member comprising a recess that does not engage the second profiled closure member; and a slider mounted to the first and second profiled closure members and movable in either a first direction to cause the profiled closure members to interlock with each other or in a second direction to cause the profiled closure members to disengage from each other, wherein the slider comprises: a closing section penetrated by respective first portions of the first and second profiled closure members, the closing end being configured such that the first portions of the first and second profiled closure members can penetrate the closing end only when the first portions are interlocked; an opening section penetrated by respective second portions of the first and second profiled closure members, the opening end being configured such that the second portions of the first and second profiled closure members can penetrate the opening end when the second portions are not interlocked, the opening section comprising a keeper shaped and positioned to engage the recess in the first profiled closure member; and a central section connecting the opening section to the closing section, the central section comprising first and second ridges proximal to the opening section, the first and second ridges respectively comprising first and second convex surfaces of curving form having respective shapes designed to maintain the recess of the second portion of the first profiled closure member in engagement with the keeper when the slider is traveling in the second direction.

Yet another aspect of the invention is an assembly comprising a zipper and a slider mounted to the zipper and movable in opening and closing directions along the zipper, the zipper comprising first and second interlockable profiled closure members relatively rotatable about a fulcrum to transition from an interlocked state to an at least partially disengaged state within the slider, the first closure member comprising a recess not engageable with the second closure member, and the slider comprising: opposing curved surfaces that contact the first and second closure members during slider travel in the opening direction with respective orientations such that respective lower portions of the first and second closure members are pushed together and deflected upward, the pressing together causing the respective portions of the first and second closure members to rotate about the fulcrum and transition from the interlocked state to an at least partially disengaged state within the slider; a keeper that engages the recess in the deflected upward portion of the first closure member to a degree sufficient to maintain the first closure member in an at least partially disengaged state within the slider; and means for retaining the slider on the zipper.

A further aspect of the invention is a reclosable package comprising: a receptacle having a mouth; and a slider-zipper assembly joined to the receptacle in a manner such that the mouth is closed when the profiled closure members are interlocked with each other and the mouth is open when the profiled closure members are disengaged from each other, the slider-zipper assembly being as described in any of the preceding four paragraphs.

Other aspects of the invention are disclosed and claimed below.

DETAILED DESCRIPTION OF THE PREFERRED EMBODIMENTS

Figure 2:
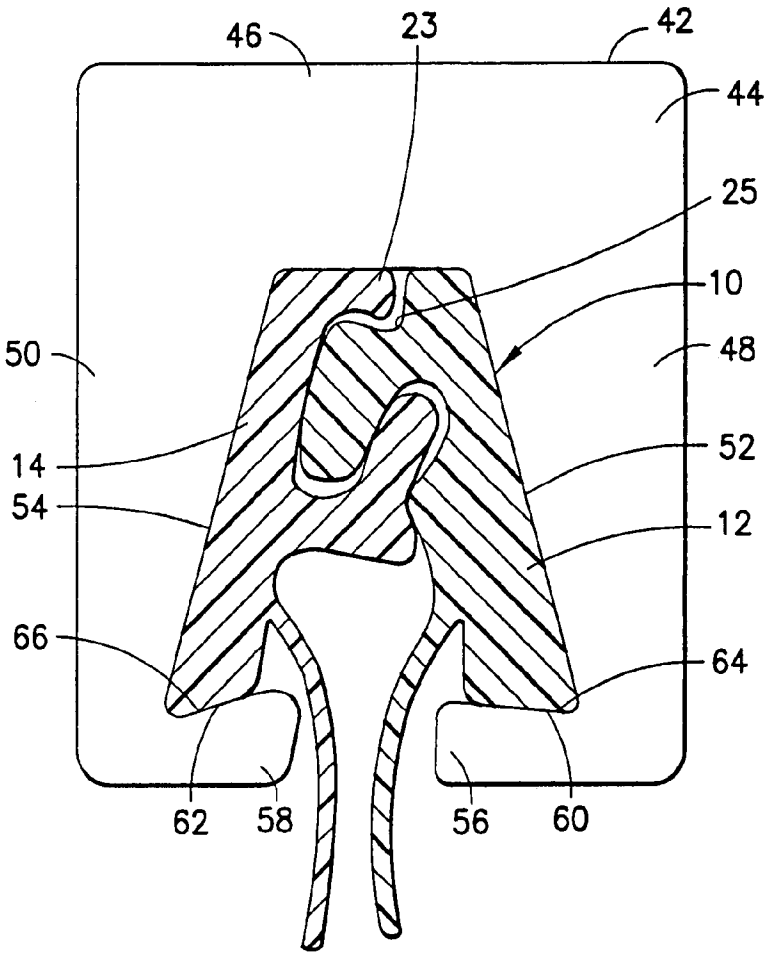
FIG.2 PRIOR ART
FIG. 2 is a drawing showing a sectional view of the same zipper as presented in FIG. 1, with a slider mounted thereto. The closing end of the slider is shown.
Figure 1:
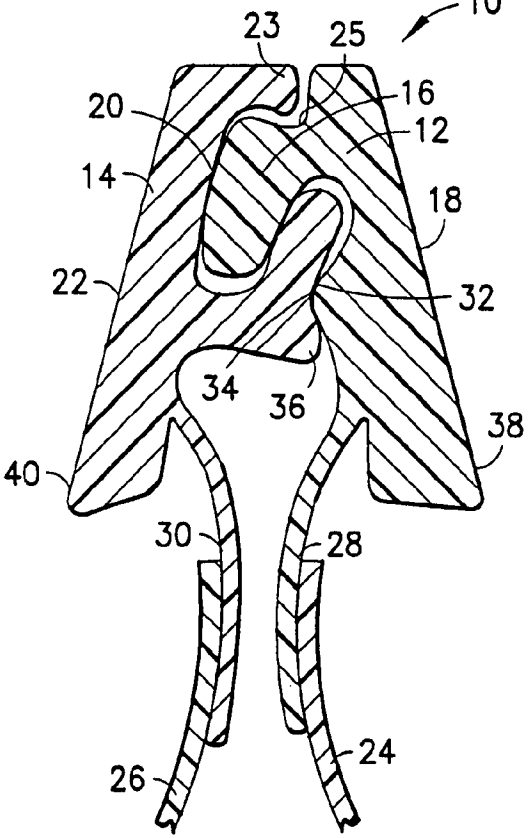
FIG.1 PRIOR ART
FIG. 1 is a drawing showing a sectional view of a closed zipper of a known type.
Figure 3:
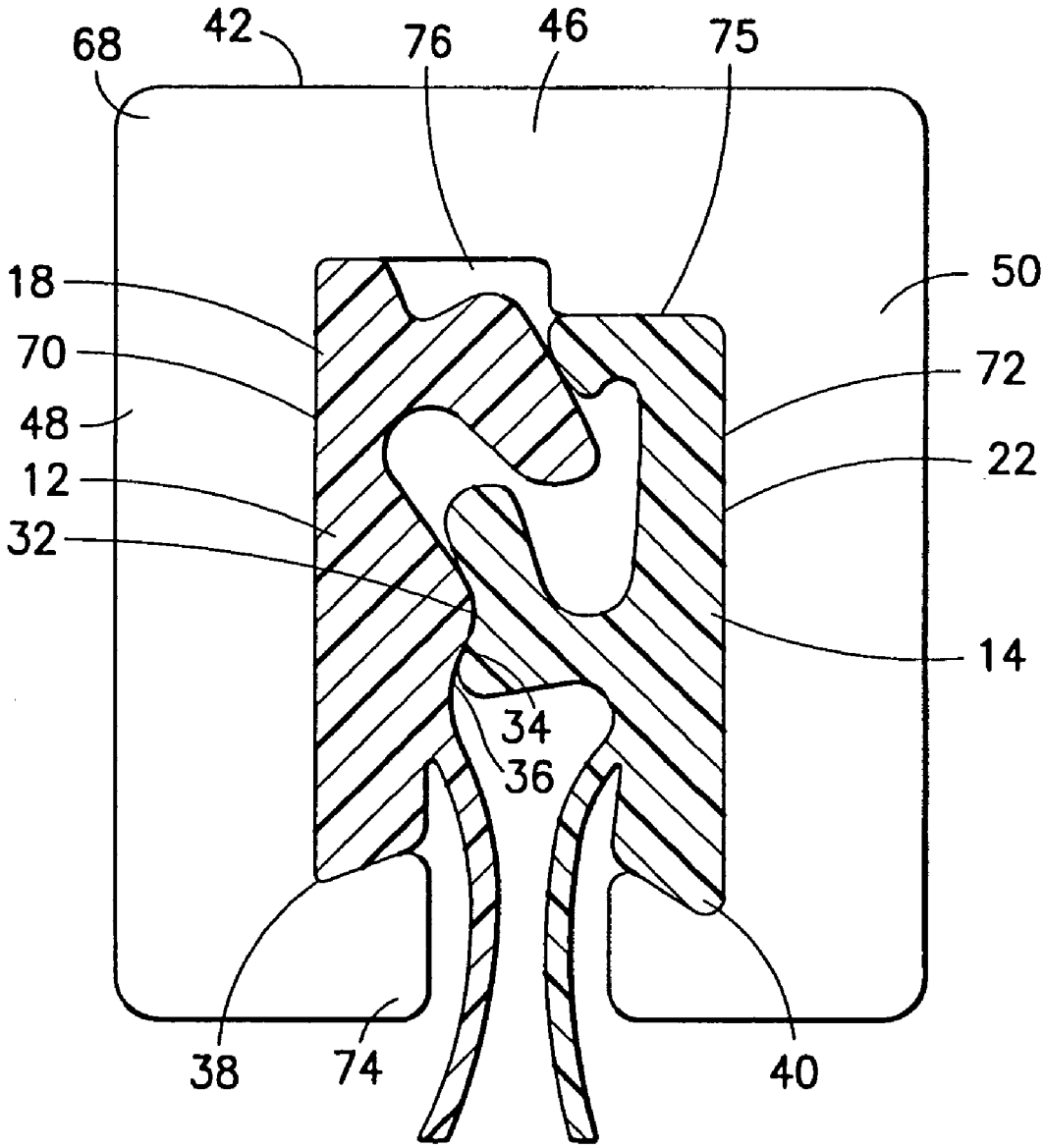
FIG.3 PRIOR ART
FIG. 3 is a drawing showing a sectional view of the same zipper as presented in FIG. 1, with a slider mounted thereto. The opening end of the slider is shown.

The disclosed embodiment of the present invention has some similarity to the known slider-zipper assembly depicted in FIGS. 1–3.

FIG. 1 shows a cross-sectional view of a known plastic zipper 10. The zipper 10 is preferably formed of a resilient plastic material, such as polyethylene, and comprises a first profiled closure member 12 and a second profiled closure member 14. The first closure member 12 comprises a male member 16 designed to interlock with the second closure member 14 and a relatively stiff base 18. Similarly, the second closure member 14 comprises a female member 20 designed to interlock with the male member 16 of the first closure member 12 and a relatively stiff base 22. The zipper 10 further comprises extensions or flanges 28 and 30. One end of flange 28 is connected to base 18, while one end of the other flange 30 is connected to base 22.

The zipper 10 can be sealed to the mouth of a receptacle in a well-known manner to form a reclosable bag. In particular, as shown in FIG. 1, flange 28 is permanently sealed (e.g., by conduction heat sealing) to one wall 24 of the receptacle, while flange 30 is permanently sealed to the other wall 26 of the receptacle. In one type of bag, the wall 24 and 26 are integrally connected at a fold line situated at the bottom of the bag. Although not shown in FIG. 1, the walls 24 and 26 are also joined at the sides of the package, at least from the bottom to the slider end stops on the zipper, by respective side seals. The bag walls 24 and 26 are formed of a suitable plastic film material for the product to be contained within the package.

Instead of dual flanges of substantially equal length, the zipper flanges can be unequal in length. Alternatively, the zipper flanges could be connected at their distal ends with a line of reduced tear resistance running along the cusp. In accordance with a further alternative, the zipper profiles could be connected by a continuous membrane which is cut on one side to form split flanges, one being longer than the other, and the long flange being sealed to both walls of the receptacle and having a tear line therein. In a further alternative, the zipper and bag making film could be extruded as one piece.

As is clear from FIG. 1, the outer surface of the bases 18 and 22 are not parallel, but diverge downwardly to form a shape that resembles the letter "A". Because of this "A" configuration, the zipper is difficult to open from the contents (i.e., product) side of the receptacle since the opening force tends to push the lower extremities of the profiled closure members apart, thereby enhancing the interlock between the male member 16 and the female member 20.

The male profiled closure member 12 also includes a convex fulcrum member 32 which engages a concave fulcrum member 34 of the female profiled closure member 14 to form a fulcrum 36, as shown in FIG. 1. The fulcrum 36 is not equidistant between the bases 18 and 22, but rather is offset closer to the closure member 12. The surfaces of the fulcrum members 32 and 34 are contoured to form a seal between the interlocked closure members 12 and 14 at the fulcrum 36.

When the distal edges 38 and 40 of the bases 18 and 22, respectively, are forced towards each other, the resulting leverage causes the closure members 12 and 14 to pivot oppositely about the fulcrum 36 and disengage from each other, as shown in FIG. 3. The male member 16 is shaped to readily permit easy disengagement from the female member 20. A top latch 23 on the female member 20 is resiliently releasable from the top cavity or indent 25 in the male member 16 to permit opening upon a force being applied to the latch 23 by an upper shoulder 75 (see FIG. 3) on an associated slider, as will be described in greater detail below. To ensure proper pivoting of the closure members 12 and 14, the bases 18 and 22 should be more rigid than the male and female members 16 and 20. This may be achieved, for example, by making the bases 18 and 22 thicker than the resilient portions of members 16 and 20.

To facilitate opening and closing of the zipper 10, the zipper 10 is provided with a straddling slider 42, as shown in FIG. 2. The slider 42 can be top-loaded onto the zipper without having to disengage the profiled closure members at the loading point since the slider does not make use of a separating finger. The slider is slidable along the zipper in either a closing direction or an opening direction opposite to the closing direction. The closure members 12 and 14 are fully engaged, i.e., interlocked, with each other as the slider travels in the closing direction. The closure members 12 and 14 are disengaged from each other as the slider travels in the opening direction. The slider 42 is preferably made of a resilient plastic material, such as delrin, polypropylene, PBT, etc.

FIG. 2 depicts a closing end 44 of the slider 42, with the zipper 10 shown in cross section. The closing end is shaped to force the closure members 12 and 14 into engagement when the slider 42 travels in the closing direction. The closing end 44 is so-called because it is the end where the zipper closure members 12, 14 are forced into engagement when the slider 40 is moved in the closing direction, i.e., opposite to the closing end 44. During slider travel in the closing direction, the closing end is the trailing end of the slider.

As shown in FIG. 2, the slider 42 straddles the zipper 10 and has a top 46 from which a first arm 48 and a second arm 50 depend. The first arm 48 has an inner surface 52 and the second arm 50 has an inner surface 54. The slider inner surfaces 52 and 54 are divergent with respect to each other in the same manner as the zipper bases 18 and 22, and are spaced to push the closure members 12 and 14 into engagement as the slider 42 is moved along the zipper 10 in the closing direction. The slider arms 48 and 50 are respectively provided with retaining shoulders 56 and 58 having upper surfaces 60 and 62 which mate with lower surfaces 64 and 66 of the closure members 12 and 14. The surfaces 60, 62, 64, and 66 may be tapered to maximize their pull-off resistance. The mating of these surfaces, in combination with the "A" configuration of the profiled members 12, 14, prevents the slider 42 from being inadvertently pulled off the zipper 10 during use, since an upward pulling motion will tend to pull the profile bases 18, 22 apart at their distal ends 38, 40, thereby locking the slider 42 onto the zipper 10.

Opening of the zipper 10 is achieved when the slider 42 is moved in the opening direction. As shown in FIG. 3 (which views the slider from the side opposite to that seen in FIG. 2), at the opening end 68 of the slider, the slider arms have inner surfaces 70 and 72 which are substantially parallel, rather than divergent as at the closing end 44 (shown in FIG. 2). Additionally, the first slider arm 48 has a retaining shoulder 74 (as shown in FIG. 3) that is thicker than retaining shoulder 56 at the closing end 44 (as shown in FIG. 2), and a shoulder 75 extending downwardly from the slider top portion 46.

As the slider is moved in the opening direction and the slider arm inner surfaces change from the "A" configuration (or trapezoidal window) of surfaces 52 and 54 (see FIG. 2) to the substantially parallel configuration (or rectangular window) of surfaces 70 and 72 (see FIG. 3), the distal edges 38 and 40 of the profile bases 18 and 22 are forced towards each other, thereby forcing the fulcrum members into a tighter relationship and causing the closure members 12 and 14 to pivot oppositely about the fulcrum 36. Simultaneously, the retaining shoulder 74 on slider arm 48 forces the male profile 12 upward, while shoulder 75 holds the female profile 14 in place, thereby causing the convex male fulcrum member 32 to cam upwardly along the concave female fulcrum member 34. Thus, as is shown in FIG. 3, the resulting action is a simultaneous pivoting of the closure members 12 and 14 oppositely about the fulcrum 36 and an upward translation of closure member 12 relative to closure member 14, resulting in disengagement of the profiled closure members, as shown in FIG. 3. A cavity 76 in the slider top accommodates the upward translation of the male profiled closure member 12.

Figure 4:
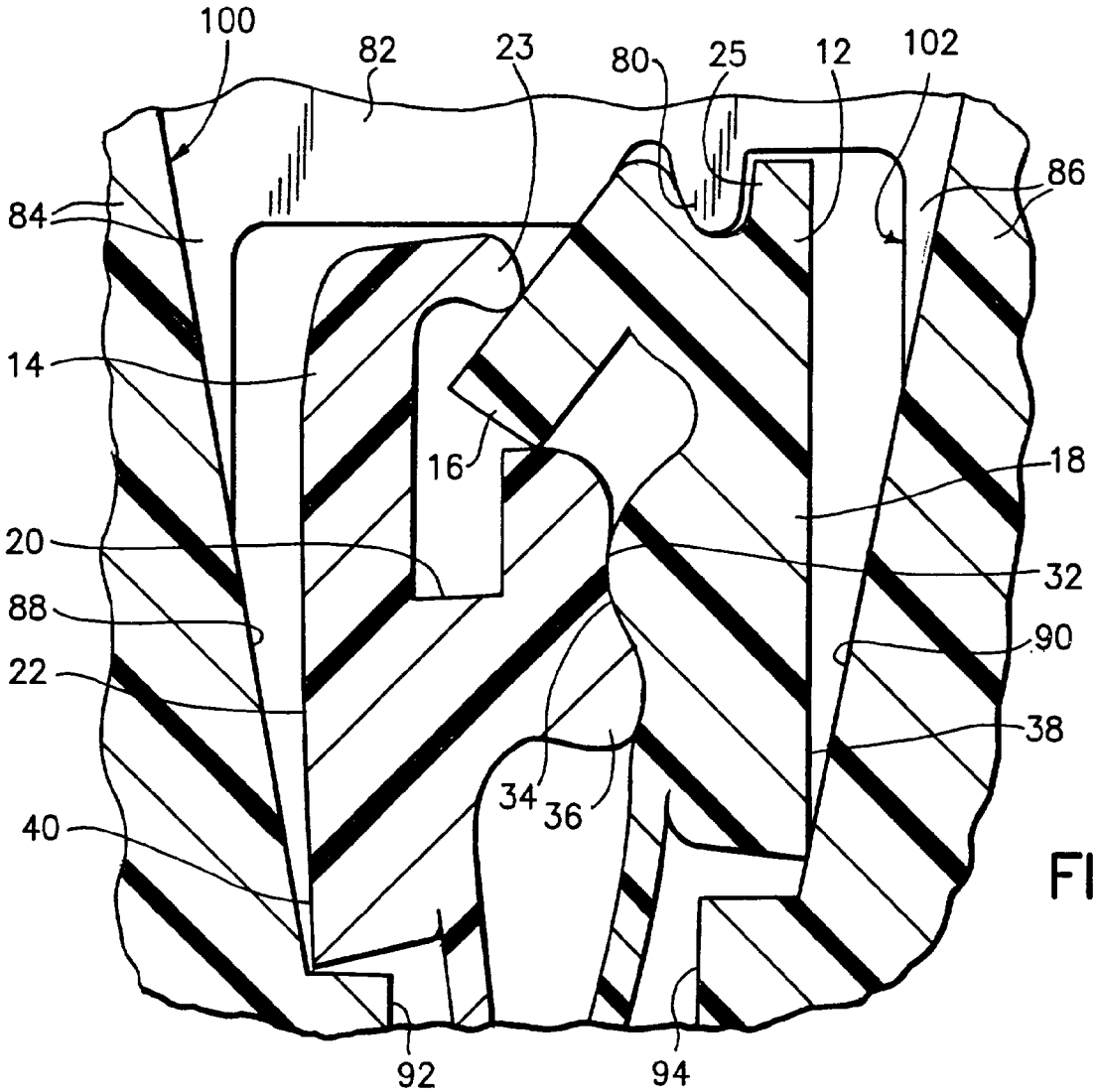
FIG. 4 is a drawing showing a sectional view of portions of a slider-zipper assembly in accordance with one embodiment of the present invention. The opening end of the slider is shown.
Figure 5:
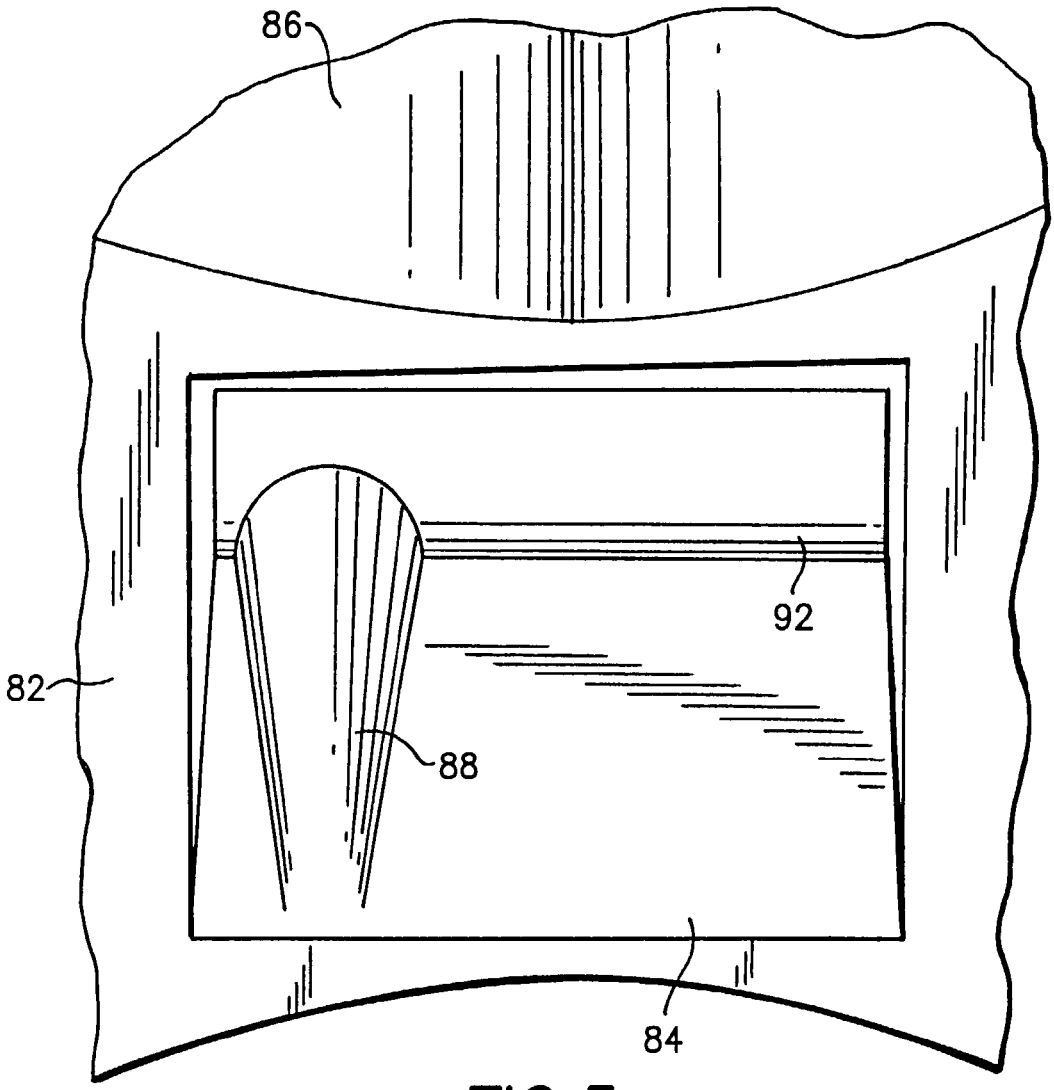
FIG. 5 is a drawing showing a perspective view of portions of the slider in accordance with the disclosed embodiment of the invention. The view is taken through the top of the slider, but at an oblique angle to one side of the slider.
Figure 6:
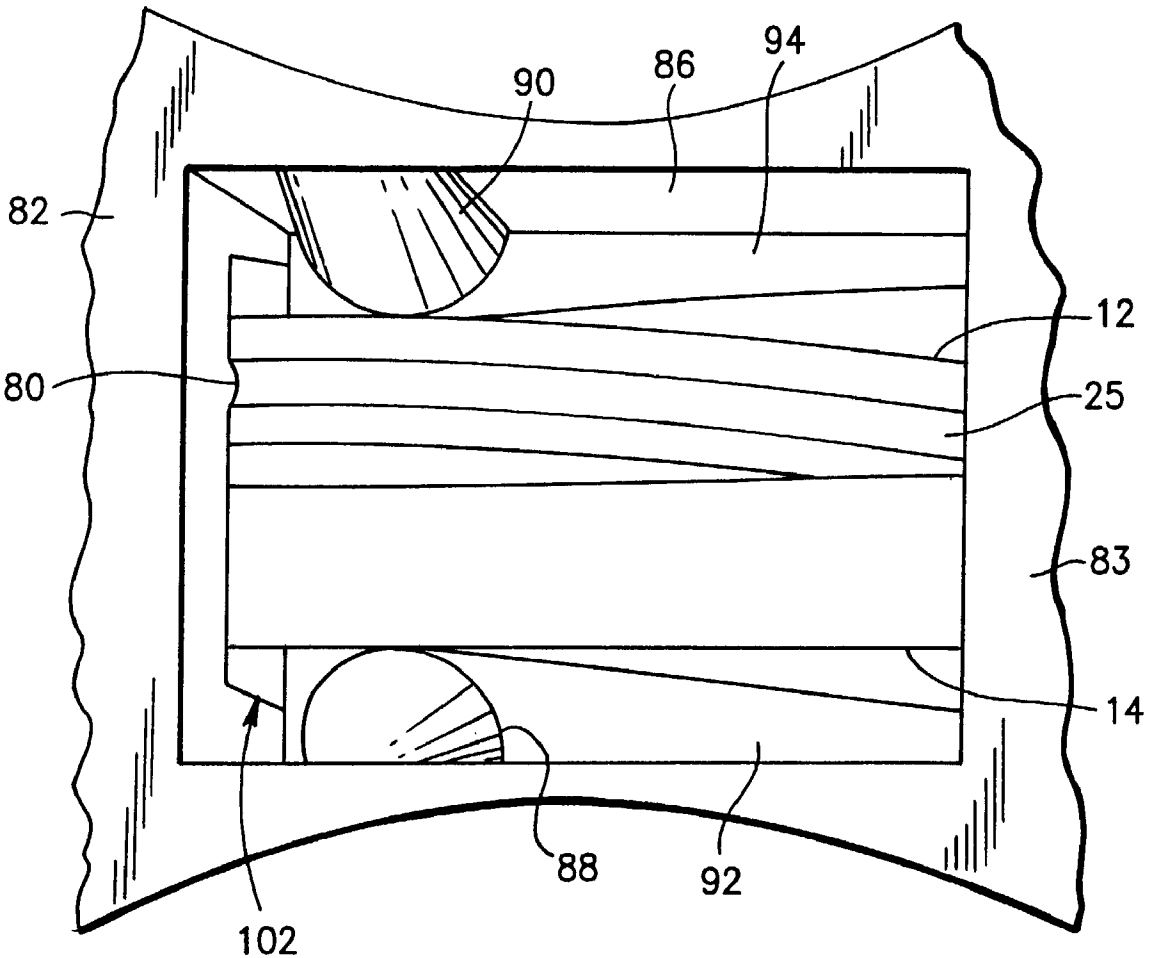
FIG. 6 is a drawing showing a perspective view of portions of the slider-zipper assembly in accordance with the disclosed embodiment of the invention. Again the view is taken through the top of the slider, but at an oblique angle looking from one end of the slider.

One embodiment of the present invention will now be described with reference to FIGS. 4–14. FIGS. 4 and 6 show portions of that slider mounted to a zipper. The same reference numerals will be used to designate elements of the zipper as were used in FIG. 1. FIG. 5 depicts portions of the slider not mounted to a zipper. FIGS. 7–14 show different views of the slider.

Figure 7:
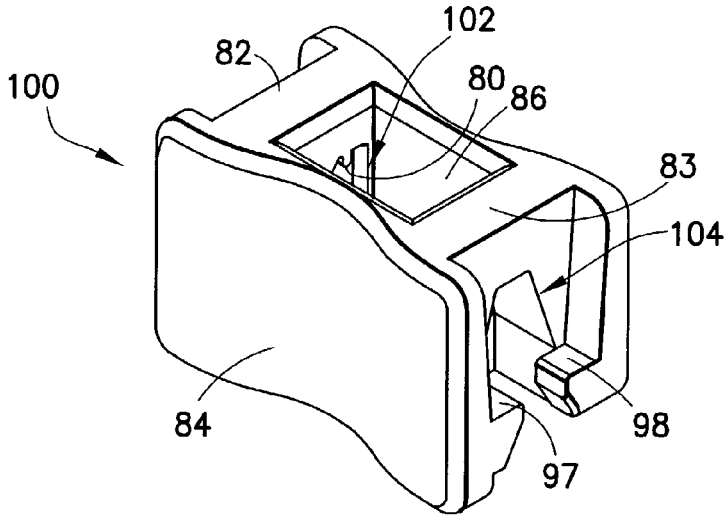
FIG. 7 is a drawing showing an isometric view of the slider in accordance with the disclosed embodiment of the invention.
Figure 8:
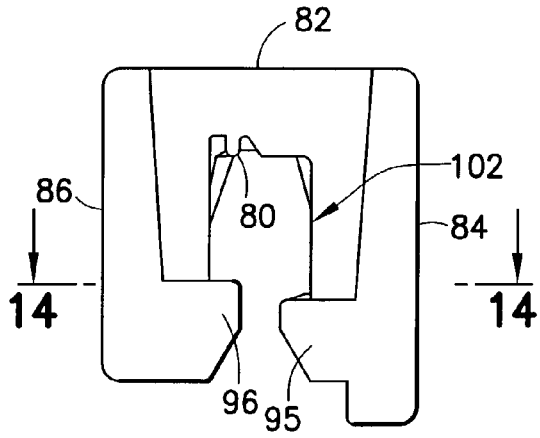
FIGS. 8 and 9 are drawings showing opening end and closing end views, respectively, of the slider depicted in FIG. 7.
Figure 10:
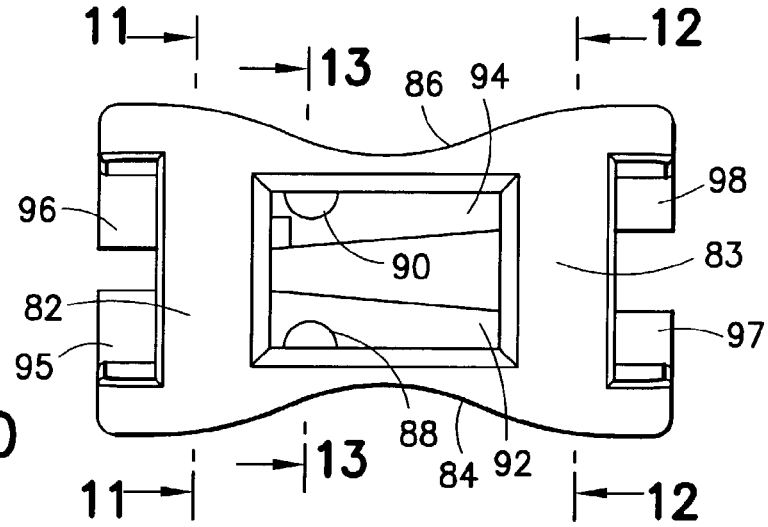
FIG. 10 is a drawing showing a top view of the slider depicted in FIG. 7.
Figure 11:
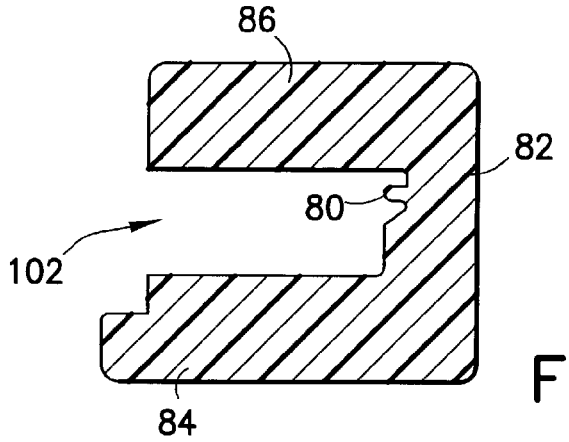
FIGS. 11–13 are drawings showing sectional views of the slider depicted in FIG. 7. The sections are respectively taken along lines 11—11, 12—12, and 13—13 indicated in FIG. 10.
Figure 12:
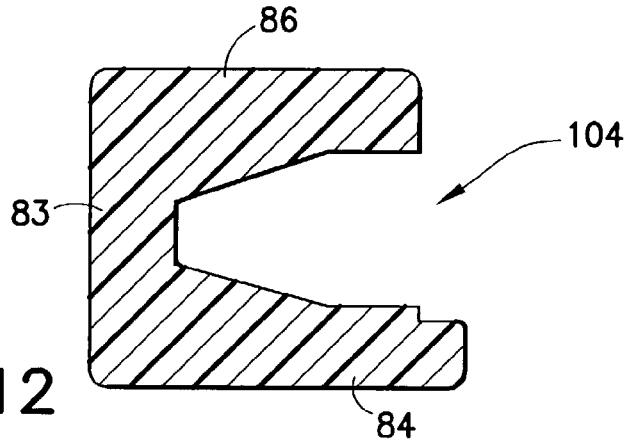

FIGS. 7 and 10 show the structure of the slider. The slider comprises a pair of arms 84 and 86 separated by a gap, a first transverse top beam 82 having one end connected to arm 84 and the other end connected to arm 86, and a second transverse top beam 83 having one end connected to arm 84 and the other end connected to arm 86. The arms and beams are integrally formed, e.g., by injection molding of the slider. The beam 82 and adjoining portions of the arms or side walls 84 and 86 define an opening window 102 (best seen in FIG. 11); the beam 83 and adjoining portions of the arms or side walls 84 and 86 define a closing window 104 (best seen in FIG. 12). As seen in FIG. 11, the opening window 102 has a generally rectangular shape; as seen in FIG. 12, the closing window 104 has a generally trapezoidal shape.

Figure 9:
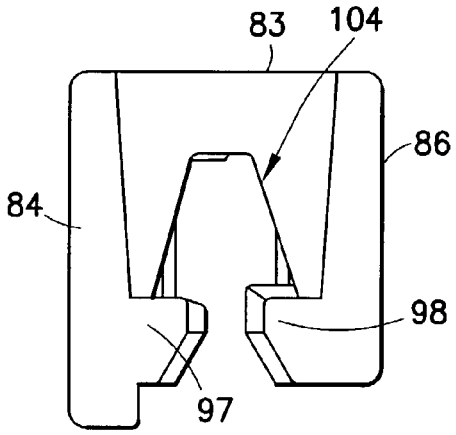
Figure 14:
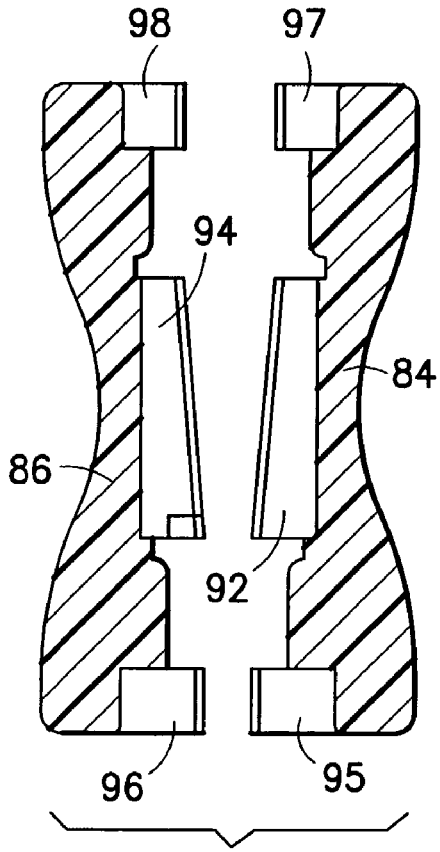
FIG. 14 is a drawing showing sectional view of the slider depicted in FIG. 7, the section being taken along line 14—14 indicated in FIG. 8.

The slider is retained on the zipper by respective sets of opposing retaining tabs projecting inward from the arms 84 and 86. As best seen in FIG. 14, a pair of long retaining tabs 92 and 94 extend generally longitudinally in a central section of the slider, the central section lying between the opening and closing windows; a pair of short retaining tabs 95 and 96 are disposed on the other side of the opening window; and a pair of short retaining tabs 97 and 98 are disposed on the other side of the closing window. The tab 94 ramps linearly upward as it approaches the opening window 102. As seen in FIG. 9, the corners of the tabs 97 and 98 are chamfered. Tabs 92, 95 and 97 are each integrally formed with arm 84; tabs 94, 96 and 98 are each integrally formed with arm 86.

The slider further comprises a pair of opposing convex curved surfaces (i.e., ridges) 88 and 90. In the disclosed embodiment, ridges 88 and 90 are integrally formed with and project from the arms 84 and 86, respectively, of slider 100. The shape of ridges 88 and 90 is best seen in FIG. 5 and 6. In the disclosed embodiment, each ridge is generally conical in shape. However, other convex surfaces of curving form can be used and the invention is not limited to camming ridges or surfaces having a conical shape. The base of ridge 88 is connected to and to integrally formed with retaining tab 92, while the base of ridge 90 is connected to and integrally formed with retaining tab 94. Each ridge tapers upward in a direction generally transverse to the respective central retaining tab.

Figure 13:
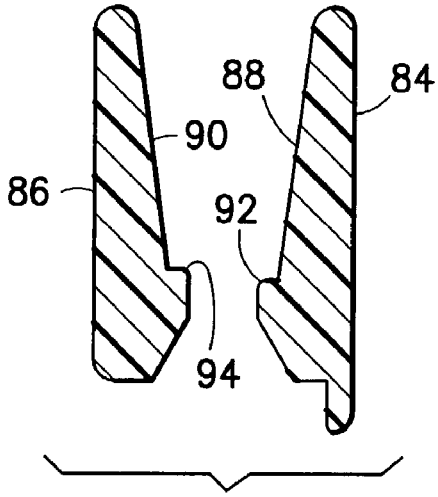

As seen in FIG. 6, the ridges 88 and 90 are located proximal to the opening window 102 in opposition to each other. These opposing curved surfaces contact the closure members 12 and 14 during slider travel in the opening direction. As seen in FIGS. 4 and 13, the crests of the ridges 88 and 90 diverge in the upward direction. As the slider travels in the opening direction, the respective adjoining portions of closure members 12 and 14 are pushed together and deflected upward. This pressing together causes the respective portions of closure members to rotate about the above-described fulcrum and transition from an interlocked or closed state to an at least partially disengaged or opened state. The partially disengaged closure members 12 and 14 can be seen through the opening in the top of the slider shown in FIG. 6.

FIG. 4 shows a sectional view taken facing the opening end of the slider, with closure members 12 and 14 of the zipper in the at least partially disengaged state. The section is taken in a plane that is generally located, relative to the slider, along the line designated 13—13 in FIG. 10. As seen in FIG. 4, the slider comprises a keeper 80 extending downward from the first top beam 82 and disposed between arms or side walls 84 and 86. In the state depicted in FIG. 4, the keeper 80 secures the closure member 12 to prevent it from moving toward the mating closure member 14. The closure member 12 includes a recess 25 to accommodate the keeper 80. By preventing movement of the closure member 12 towards the closure member 14, the closure members remain at least partially disengaged at the opening end, thereby reducing the possibility of an unintentional full engagement of the closure members adjacent the opening end or within the slider. The closure member 12 of the zipper has been cammed upward by the crest of ridge 90 until the keeper 80 is nestled snugly in the recess 25 formed in the top of the profile of closure member 12. Similarly, the ridge 88 on the opposite side of the slider cams the closure member 14 toward the closure member 12. Thus the ridges 88 and 90 serve to increase the force exerted by the slider on the zipper profiles, thereby increasing its effectiveness in opening the zipper, as well as reducing the load on the keeper and providing a more positive opening. The result is a slider-zipper assembly that will not deactivate at freezer temperatures absent unusual circumstances, while also working well at warmer temperatures.

It is known to apply a slider-operated zipper to a web of bag making film as the film is being advanced toward a form-fill-seal (FFS) machine. In one known system, a zipper tape is unwound from a spool and advanced to a device for forming slider end stops, e.g., by crushing or ultrasonic stomping. The stomped zipper tape is then advanced to a slider insertion device, which inserts a respective slider on each increment of zipper corresponding to the length of the zipper in the reclosable package. In the case of the slider-zipper assembly depicted in FIG. 4, the slider insertion device both inserts a slider on the zipper tape and simultaneously activates a section of the zipper tape at the opening end of the inserted slider.

The disclosed embodiment has discontinuous slider arm inner surfaces (i.e., opening and closing windows 102 and 104) and discontinuous retaining tabs 92 and 94–98, with a large chamber provided in a central section between the opening and closing windows. However, the slider arm inner surfaces that act on the zipper and the retaining shoulders or tabs that retain the slider on the zipper may be continuous along the length of the slider.

While the invention has been described with reference to preferred embodiments, it will be understood by those skilled in the art that various changes may be made and equivalents may be substituted for members thereof without departing from the scope of the invention. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

What is claimed is:

1. A slider for opening and closing a plastic zipper, comprising:

an opening window comprising a top portion, first and second side portions respectively connected to opposing ends of said top portion of said opening window, and a keeper connected to and projecting downward from said top portion, said keeper being disposed closer to said first side portion than to said second side portion of said opening window;

a closing window comprising a top portion, and first and second side portions respectively connected to opposing ends of said top portion of said closing window, said closing window being separated from said opening window by a central connecting zone; and a first ridge located in said central zone proximal to said opening window and comprising a first convex surface of curving form, wherein said first convex surface of curving form is tapered upward.

2. The slider as recited in claim 1, wherein said top portion and said first and second side portions of said opening window bound a generally rectangular space, and said top portion and said first and second side portions of said closing window bound a generally trapezoidal space.

3. The slider as recited in claim 1, further comprising a tab located in said central zone, wherein said tab ramps upward as it approaches said opening window.

4. The slider as recited in claim 1, further comprising first and second side walls disposed on opposing sides of said slider, said first side wall connecting said first side portion of said opening window to said first side portion of said closing window, and said second side wall connecting said second side portion of said opening window to said second side portion of said closing window, where in said first ridge is connected to said first side wall.

5. The slider as recited in claim 4, wherein said first and second side walls, said opening and closing windows, and said first ridge are integrally formed as parts of a monolithic molded body.

6. A slider for opening and closing a plastic zipper, comprising:

an opening window comprising a top portion, first and second side portions respectively connected to opposing ends of said top portion of said opening window, and a keeper connected to and projecting downward from said top portion, said keeper being disposed closer to said first side portion than to said second side portion of said opening window;

a closing window comprising a top portion, and first and second side portions respectively connected to opposing ends of said top portion of said closing window, said closing window being separated from said opening window by a central connecting zone; and a first ridge located in said central zone proximal to said opening window and comprising a first convex surface of curving form, wherein said first convex surface of curving form is generally conical.

7. The slider as recited in claim 6, wherein said top portion and said first and second side portions of said opening window bound a generally rectangular space, and said top portion and said first and second side portions of said closing window bound a generally trapezoidal space.

8. The slider as recited in claim 6, further comprising a tab located in said central zone, wherein said tab ramps upward as it approaches said opening window.

9. The slider as recited in claim 6, further comprising first and second side walls disposed on opposing sides of said slider, said first side wall connecting said first side portion of said opening window to said first side portion of said closing window, and said second side wall connecting said second side portion of said opening window to said second side portion of said closing window, wherein said first ridge is connected to said first side wall.

10. A slider for opening and closing a plastic zipper, comprising:

an opening window comprising a top poraion, first and second side portions respectively connected to opposing ends of said top portion of said opening window, and a keeper connected to and projecting downward from said top portion, said keeper being disposed closer to said first side portion than to said second side portion of said opening window;

a closing window comprising a top portion, and first and second side portions respectively connected to opposing ends of said top portion of said closing window, said closing window being separated from said opening window by a central connecting zone;

a first ridge located in said central zone proximal to said opening window and comprising a first convex surface of curving form; and a second ridge located in said central zone proximal to said opening window, said second ridge being generally opposed to said first ridge and comprising a second convex surface of curving form, wherein each of said first and second convex surfaces of curving form has a shape designed to cam the profiles of a zipper toward each other and toward said top portion of said opening window when the zipper is being opened by said slider.

11. The slider as recited in claim 10, further comprising first and second tabs located in said central zone and generally opposed to each other, said first tab being generally disposed between said first side portions of said opening and closing windows, and said second tab being generally disposed between said second side portions of said opening and closing windows.

12. The slider as recited in claim 11, wherein a base of said first ridge is connected to said first tab and a base of said second ridge is connected to said second tab.

13. The slider as recited in claim 11, further comprising third and fourth tabs located in a first end zone separated from said central zone by said opening window and generally opposed to each other, and fifth and sixth tabs located in a second end zone separated from said central zone by said closing window and generally opposed to each other.

14. A slider for opening and closing a plastic zipper of the type having a fulcrum, comprising:

first and second side walls separated by space occupied in part by the zipper;

a first beam having one end connected to said first side wall and the other end connected to said second side wall, said first beam and respective first portions of said first and second side walls adjoining said first beam defining an opening window;

a second beam having one end connected to said first side wall and the other end connected to said second side wall, said second beam and respective second portions of said first and second side walls adjoining said second beam defining a closing window;

first and second tabs respectively projecting from said first and second side walls and toward each ocher for retaining the slider on the zipper; and a first ridge projecting from said first side wall proximal to said opening window and comprising a first convex surface of curving form, wherein said first convex surface of curving form is tapered upward.

15. The slider as recited in claim 14, wherein said first beam comprises a downwardly projecting keeper.

16. The slider as recited in claim 14, wherein said first and second side walls, said first and second beams, said first and second tabs and said first ridge are integrally formed as parts of a monolithic molded body.

17. A slider for opening and closing a plastic zipper of the type having a fulcrum, comprising:

first and second side walls separated by space occupied in part by the zipper;

a first beam having one end connected to said first side wall and the other end connected to said second side wall, said first beam and respective first portions of said first and second side walls adjoining said first beam defining an opening window;

a second beam having one end connected to said first side wall and the other end connected to said second side wall, said second beam and respective second portions of said first and second side walls adjoining said second beam defining a closing window;

first and second tabs respectively projecting from said first and second side walls and toward each other for retaining the slider on the zipper; and a first ridge projecting from said first side wall proximal to said opening window and comprising a first convex surface of curving form, wherein said first convex surface of curving form is generally conical.

18. The slider as recited in claim 17, wherein said first beam comprises a downwardly projecting keeper.

19. The slider as recited in claim 17, wherein said first and second side walls, said first and second beams, said first and second tabs and said first ridge are integrally formed as parts of a monolithic molded body.

20. A slider for opening and closing a plastic zipper of the type having a fulcrum, comprising:

first and second side walls separated by space occupied in part by the zipper;

a first beam having one end connected to said first side wall and the other end connected to said second side wall, said first beam and respective first portions of said first and second side walls adjoining said first beam defining an opening window;

a second beam having one end connected to said first side wall and the other end connected to said second side wall, said second beam and respective second portions of said first and second side walls adjoining said second beam defining a closing window;

first and second tabs respectively projecting from said first and second side walls and toward each other for retaining the slider on the zipper; and a first ridge projecting from said first side wall proximal to said opening window and comprising a first convex surface of curving form; and a second ridge projecting from said second side wall proximal to said opening window and in opposition to said first ridge, wherein said second ridge comprises a second convex surface of curving form, wherein each of said first and second convex surfaces of curving form has a respective shape designed to cam the profiles of a zipper toward each other and toward said first beam when said the zipper is being opened by said slider.

21. The slider as recited in claim 20, wherein said first ridge extends generally transverse to said first tab and said second ridge extends generally transverse to said second tab.

22. A slider for use on a zipper of the type comprising a first profiled interlockable member and a second profiled interlockable member adapted to interlock with said first interlockable member, said slider comprising:

a pair of spaced apart arms defining at opposite ends of said arms a zipper opening end of said slider that disengages adjoining first portions of said first and second interlockable members and a zipper closing end of said slider that interlocks adjoining second portions of said first and second interlockable members;

bridge means that span a gap between said arms, said bridge means being connected to top portions of said arms;

means for keeping said first portion of said first interlockable member at least partially disengaged from said first portion of second interlockable member in said zipper opening end;

means for camrning said first portion of said first interlockable member toward said keeping means when said slider is moved in a zipper opening direction; and means for retaining said slider on said zipper.

23. The slider as recited in claim 22, wherein said camming means is located between said zipper closing end and said zipper opening end, and is closer to said zipper opening end than to said zipper closing end.

24. The slider as recited in claim 23, wherein said camming means comprise a ridge having a generally conical surface.

* * * * *